US008671841B2

(12) United States Patent
Raquin et al.

(10) Patent No.: US 8,671,841 B2
(45) Date of Patent: Mar. 18, 2014

(54) KINETIC MUNITION OR PROJECTILE WITH CONTROLLED, NON-LETHAL EFFECTS

(75) Inventors: Cyrille Raquin, Marcoussis (FR); Richard Guillot, Bouessay (FR)

(73) Assignee: Securinov SA, Diekirch (LU)

( * ) Notice: Subject to any disclaimer, the term of this patent is extended or adjusted under 35 U.S.C. 154(b) by 115 days.

(21) Appl. No.: 12/991,256

(22) PCT Filed: May 4, 2009

(86) PCT No.: PCT/FR2009/000520

§ 371 (c)(1),
(2), (4) Date: Jan. 25, 2011

(87) PCT Pub. No.: WO2009/141521

PCT Pub. Date: Nov. 26, 2009

(65) Prior Publication Data

US 2011/0113979 A1 May 19, 2011

(30) Foreign Application Priority Data

May 7, 2008 (FR) ..... 08 02536
Jan. 23, 2009 (FR) ..... 09 00303

(51) Int. Cl.

| | |
|---|---|
| ***F42B 30/00*** | (2006.01) |
| ***F42B 12/02*** | (2006.01) |
| ***F42B 12/34*** | (2006.01) |
| ***F42B 12/72*** | (2006.01) |

(52) U.S. Cl.
USPC ..... 102/502; 102/335; 102/439; 102/517

(58) Field of Classification Search
USPC ..... 102/439, 444, 498, 502, 529, 335, 517
See application file for complete search history.

(56) References Cited

U.S. PATENT DOCUMENTS

| | | | | |
|---|---|---|---|---|
| 3,865,038 | A | 2/1975 | Barr | |
| 4,823,702 | A | 4/1989 | Woolsey | |
| 6,041,712 | A * | 3/2000 | Lyon | 102/439 |
| 6,283,037 | B1 | 9/2001 | Sclafani | |
| 7,086,337 | B2 * | 8/2006 | Klein | 102/502 |
| 7,503,260 | B2 * | 3/2009 | Kapeles | 102/502 |
| 7,526,999 | B1 * | 5/2009 | Timan | 102/502 |
| 7,631,601 | B2 * | 12/2009 | Feldman et al. | 102/502 |
| 7,743,708 | B1 * | 6/2010 | Lawrence | 102/502 |
| 8,186,275 | B1 * | 5/2012 | Woodall et al. | 102/502 |

(Continued)

FOREIGN PATENT DOCUMENTS

| | | |
|---|---|---|
| FR | 9711361 | 9/1997 |
| WO | 9523952 | 9/1995 |
| WO | WO-95/23952 | 9/1995 |
| WO | WO-99/14551 | 3/1999 |

*Primary Examiner* — James Bergin
(74) *Attorney, Agent, or Firm* — Muncy, Geissler, Olds & Lowe, P.C.

(57) ABSTRACT

The invention relates to a ballistic ammunition or projectile that is non-lethal or has controlled effects, of small or medium caliber. An internal structure is provided, made of a low-density cellular material with an elongation at break of less than 10%. An external casing encases the structure. The casing is made of a low hardness material with an elongation at break in excess of 100%. The casing is attached to the structure. The projectile may contain at least one cavity containing a different material from that of the structure and may also contain a payload.

13 Claims, 1 Drawing Sheet

(56) References Cited

U.S. PATENT DOCUMENTS

| | | | | |
|---|---|---|---|---|
| 2004/0089186 | A1* | 5/2004 | Brygdes-Price | 102/502 |
| 2005/0066849 | A1* | 3/2005 | Kapeles et al. | 102/517 |
| 2005/0155511 | A1* | 7/2005 | Keegstra et al. | 102/444 |
| 2006/0027124 | A1 | 2/2006 | Sclafani | |
| 2006/0111719 | A1 | 5/2006 | Strobel | |
| 2007/0151473 | A1* | 7/2007 | Brunn | 102/444 |
| 2007/0289475 | A1* | 12/2007 | Kapeles | 102/502 |
| 2008/0178758 | A1* | 7/2008 | Kapeles et al. | 102/502 |

* cited by examiner

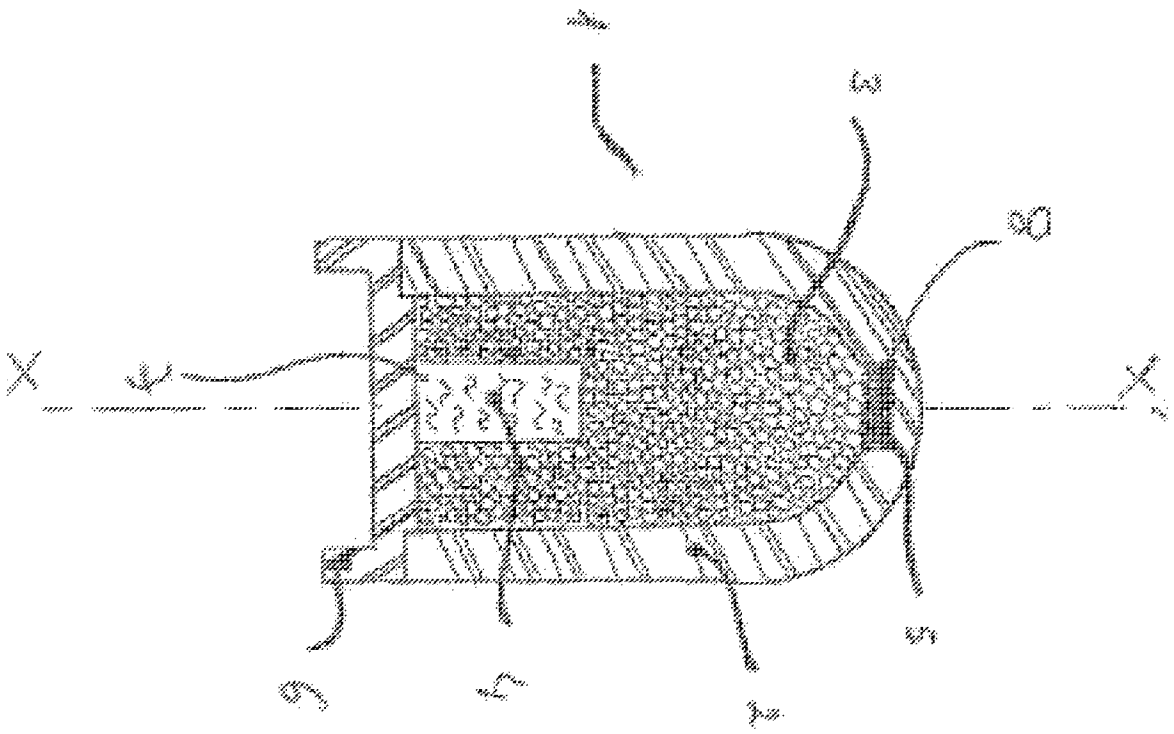
X'
8
3
1
2
4
X
5
6

KINETIC MUNITION OR PROJECTILE WITH CONTROLLED, NON-LETHAL EFFECTS

FIELD OF THE INVENTION

The present invention relates generally to the field of non lethal or less than lethal kinetic ammunitions utilized by law enforcement units and military forces in peace keeping missions and, more particularly, to projectiles having embedded electronics or additional effects, especially suited for individual firearms or launchers.

BACKGROUND OF THE INVENTION

Most so-called less than lethal projectile bodies are actually made from a plastic or molded polymer material. Non-lethal projectile noses are typically made of an elastic foamed polymer or other compliant material like rubber projectiles of different forms usually used by law enforcement. Different projectiles are characterized by the specificity of the used material, such as those described in patent WO95/23952 or U.S. Pat. No. 3,865,038.

For most projectiles, energy transfer occurs at a diameter not far from the initial caliber. A significant part of the energy is lost in recoil, necessitating more initial speed to deliver adequate energy. These characteristics result in injuries at short range shooting ranges.

Most technical versions are built with elastic, or deformable material or structures, like Bean Bags or products made using Patent No. FR9711361 which uses fine divided solid material in an elastic deformable bag sold under the trademark, BLINIZ. These projectiles bring a greater expansion of the impact without tear at usual impact speeds for law enforcement guns. This product represents a significant enhancement over other existing products due to the wide impact area. But the constraint remains very high in the center of the impact for a short time. But these projectiles are highly deformable and are very unstable in both internal and external ballistic phases due to the free particles inside its elastic walls. Therefore, the constraint in the central area of an impact zone remains high and contributes to the transfer to the receptor target for an important part of the projectile kinetic energy which remains concentrated in the center of the impact area. The distribution of kinetic energy by the surface unit remains variable on the impact surface for all known modes of realization. A known way to reduce such central constraints is to add a high level of amortizing and a low density in the forward part that affect ballistic or stability characteristics.

U.S. Pat. No. 6,283,037 adapt the characteristics to lead to the rupture of the elastic bag if the mechanical constraint overcome a defined threshold, this elastic bag is inserted inside external hard foam hull that breaks at impact with some energy absorption.

United States Patent Application Publication No. 2006/027124 use the same idea, encapsulating the bag in a fragile crushable cocoon that breaks at impact. This publication is applicable for shotguns with small caliber (typically less than 25 mm diameter) and the projectile is fully inserted inside a cartridge and is could not be manipulated directly. The major negative point is that such external hull is characterized by a free surface, which unfixed, and as the result such foam couldn't be used completely to absorb shock energy, the obtained result is therefore a rupture of this hull in several fragments when impacting the target. In addition these splits or parts could be harmful, especially when using hard foam or molded with a skin effect like polyurethane.

U.S. Pat. No. 4,823,702 describes a projectile constituted of a grain agglomerate linked inside a breakable polymer matrix and fixed to the external hull on his rear part. The purpose of such fastening is here to maintain the axial position of the internal solid like compound that will divide at impact in divided solids grains, the difference versus patent FR9711361 is here the size and nature of the said grains or parts. Known state of the art allow the shock spreading on a larger surface, but as a matter of fact didn't provide a significant elongation of the impact duration, due to the important density of used materials. At impact, the implied force onto the target rises rapidly in intensity and reaches his maximum before the spreading. The result is important damages usually took place in the central impact area and if the target is strong enough to avoid penetration, the surface area or the force application growth and fade the local effect.

United States Patent Application Publication No. 2004/089186 describes a non penetrating projectile to deliver anesthesia injection that could be used as a non lethal projectile by the use of a pressurized content or a pyrotechnic gas generator that inflate an elastic capacity, the inflation of the said capacity is triggered by a proximity or contact fuse in the projectile forehead. This patent is the application of the well-known car airbags technologies to protect people from injuries during a car crash. The integration in the forward part of the projectile of a proximity fuse or shock detection sensor is simply mater of miniaturization of what is done in a vehicle at impact. It is quite difficult and relatively expansive to industrialize and manufacture in a small caliber projectile. The way the pressurized capacity expand create a gas inflated volume which doesn't participate to spread the material situated rearward, it only amortize the effect of a hard device situated on the rear part to realize a product injection. The description of this said patent, describe a protection of the forward part or nose with a thin or breakable part at impact, this added part is designed to maintain an aerodynamically profile during the flight, but such design may create some wound problem at impact and is certainly a difficult compromise to realize between aerodynamic efficiency and injuring fragment at impact.

Other so-called non lethal projectiles are designed with an elastic polymer foam head, and cope with the problem to find a compromise between density, elasticity and the speed of impact. Usual constraints are to sustain the initial acceleration, the trajectory and the surface at impact to transfer the energy to the target. If the foam is of low density, the speed is decreasing rapidly and the precision is affected, if the foam is elastic and dense, the precision obtained is better but the trauma wound consequences could be worst. A compromise is therefore in the increase of the caliber and at the same time lowering their speed.

Some realizations chose the low-density foam like the EXACTIMPACT ammunition manufactured by Harmor Holding or equivalent projectiles made by others players. These projectiles need high speed to obtain sufficient precision and energy at long range, making them very harmful at low distance, usual use behind 15 meters could make severe injuries and attempt to target life.

There is a need for a projectile that could be precise at 50 meters with less acceleration and aerodynamic deformation and could deliver at this range about 100 Joules without being lethal at short range with an energy up to 200 Joules, such projectile could avoid lethal injuries when it impact vital organs.

Another solution is described in the patent publication 2006/111719, based on a high resilience and high rupture elongation characteristics containing in his forward part a hollow cavity. A technical limitation of this projectile is that there is no crush or fragmentation of material and energy due to air compression do not allow to absorb a sufficient level of energy and only will reduce the maximum impact force of a few percents. There is no duration length enhancement provided with such a realization.

U.S. Pat. No. 3,865,038 is described by Barr to deliver controlled effect in a shotgun ammunition build with an external hard polymer wall containing a powder, liquid or gas. The said external wall delimited rupture lines and reinforced areas in a way to optimize the effect of impact; the elastic and thick forward part of the head is resistant during the impact and could work as a piston to disperse the contained product in radial directions through the broken lines.

Actually, the combined use of kinetic projectile with pyrotechnic payload is quite limited by the mass of the projectile and the injuries due to splitters projection that are usually penetration into biological target.

SUMMARY OF THE INVENTION

Accordingly, it is an object of the present invention to provide a kinetic projectile that will deliver the same energy with a greater impact duration and onto a wider impact area on target.

Another object of the present invention is to provide a kinetic projectile that could be used without irreversible wound injury at short distance, down to less than 10 meters.

Other objects and advantages of the present invention will become more obvious hereinafter in the specification and drawing.

In accordance with the present invention, a non-lethal kinetic projectile of small or medium caliber is disclosed. The projectiles incorporates an internal structure made principally with a low density cellular material characterized by a rupture elongation less than 10%; an external hull or wall surrounding the said structure, made of a material with a low hardness and an elongation before rupture greater than 100%, said hull fastened to the said structure.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein:

FIG. 1 is a cross-sectional view of a non-lethal projectile of the present invention.

DETAILED DESCRIPTION OF THE INVENTION

The present invention allow to maintain the external shape of the projectile due to the quasi static resistance of the internal structure 3 on which the elastic deformable hull is fastened. This strong link between the external hull and internal structure is able to sustain the firing acceleration and the aerodynamic flight without noticeable shape deformation.

The present invention fulfill the following needs for a non lethal or controlled effects ammunition or projectile which simultaneously deform and crushes without blessing parts at impact:

Spread the incident impact kinetic energy on the larger possible spot, in a way to limit damages and traumatisms or wound injuries induces by the movement quantity transfer and kinetic energy absorption by the hit target without significant deformation during the shooting ballistic phase before.

The present invention combines and integrates the following constituents in a kinetic projectile for small or medium caliber:

Optimizing the extension of impact duration and location area spreading. Said projectiles embodies an internal rigid structure 3 with low static deformability to allow the whole projectile or ammunition to be manipulated and keep is aerodynamic shape during ballistic acceleration an flight. Said structure is housed in a hull or wall 2 made with material characterized by a high elasticity and deformation capacity.

Structure 3 can house a cavity 7 on his rear part, here filled in with an elastic material body 4, by example low reticulated polybutadiene at less than 5000 Dalton. An electronic device could be included inside said housing 4 and therefore, protected of shocks, could be able to work after impact. Said projectile could have on his forward part a second cavity 8 housing dense particles linked with a polymer in bulk 5.

Referring to FIG. 1, projectile 1 uses a sabot 6 which is fastened to the hull 3 and/or to the envelope 2 by every kind of known process and/or mechanical link able to ensure the air tightness or dustproof characteristic of said hull 2 to residual powder material of initial structure 3 after impact.

The present FIGURE is not a limitation to others executions or manufacturing that could be done upon the present invention, and especially to enhance the aspect without modifying his behavior during his life and his function. FIG. 1 is especially designed for existing single shot launcher, it is obvious that the invention could allow to design multi-projectiles systems or effectors, specifically non lethal that could be propelled by different means like pyrotechnic propulsion or gas under pressure.

At least one internal rigid crushable structure 3 which react like a skeleton and preserve the head shape and overall integrity when the ammunition is manipulated or launched, each elements of this structure breaks in a fragile rupture mode under the dynamic constraints at impact, usually constituted with alveoles or open or not cells made with a material of rupture elongation less than 10%. Used materials in such structure, whatever their chemical or atomic constitution, homogenous or composite making off, a low rupture elongation property typically less than 10%) and are fragile under mechanical stress or constrain, specifically dynamic one, and will break apart under such shearing stress of walls of said cells or honeycombs, said cells being loaded with a stress at impact successively with the result during the impact, a global fragmentation of the whole structure constitutive material in small parts like powder or dust after the impact. This residual material in powder will only take, due to the low apparent density of the initial structure 3, less than 15% of the non compressed hull 2.

A hull or external wall 2 made of an elastic polymer with low hardness property, characterized with a high elongation capacity, typically more than 100%, and that remain highly elastic even at high deformation speed that could occur during impact, One external elastic hull 2*r* of low hardness and which keep his elasticity at the impact deformation speed and act as an amortizing device with the air contained in the sealed cavity formed by the hull 2 and the projectile body or holder 6, said hull subject to visco-elastic deformation at impact due to his characteristic of elongation at rupture of more than 100%, Said hull 2 preferably fastened to the internal structure 3 by all pertinent mean, by example with glue.

In the conception of the projectile according to the invention, the center of gravity is pushed forward due to the respective density of foam (typically less than 0.15 or 150 Kg/m$^3$) and elastic polymere (that can be chosen greater than 1 which is forming a hull on the external part. Such position provide a natural equilibrium to the projectile during the ballistic phase.

With this combined parts the invention obtain:

a progressive deceleration that enable the surface spreading of the energy and movement quantities transfer area on the target using in the same purpose:

Visco-elastic deformation of the external wall or hull,

Progressive fragile rupture of the small elements or cells constituting the inside rigid structure that crushes at impact, a movement quantity transfer by soft shock to the target that limit the deterrent effects by the mean of a long contact duration shock impact, and the simultaneous surface spreading of area impact.

A realization of kinetic projectile within the invention lead to a smaller growth in the intensity of the force applied onto the target due to the successive rupture of the cells of a hard structure with a low density and therefore leading to a shock with a greater duration and as a consequence spread onto the surface as the highly deformable hull has got sufficient time to expand at is maximum diameter of deformation before the impact of the rear part, if such part does exist, especially in the case where e it is a projectile propelled by a pyrotechnic composition. The rear part action, which is in state of the art manufactured in quite hard material in order to resist to pressure and flame during the pyrotechnic combustion is then highly amortized. This rear part called sabot or holder, show in usual state of the art manufacturing a major inconvenient in case of rocking action at impact; if such rocking occurs, the rear part acts like a mechanical punch tool. In addition realization upon the present invention allows keeping an adapted aerodynamic force during ballistics and flying phases.

Said invention combine at impact amortizing made by a crushable structure plus the sealed air cavity compression and visco elastic deformation of elastic wall or hull.

This solution could be applied to design a projectile of small to medium size, preferably between 20 and 70 mm to ensure a constant repartition of kinetic energy upon the most important possible surface onto the target. The internal structure is dimensioned to support a quasi static compression or reduce level of dynamic compression (acceleration due to fire shooting) at a high level. Such characteristic allow maintaining the external hull which is highly elastic and of low hardness under low level of aerodynamic formation at the speed reached by said projectile.

The present invention specifically attenuate the central constraint effect of actual devices, using a crushable and amortizing part working with a progressive resistance and with an expanding surface of action at impact, said expansion is sufficiently extended to prevent the rear part, generally harder to participate at the impact effects.

Manners to realize projectiles up to the invention are described here after, as simple non limitative examples, and with a reference to drawing annexed as FIG. 1 that shows a section of a projectile 1. Consequently, said projectile 1 made upon the present invention shows important advantages at constant mass due to the elongation of impact, applying limited action onto the target and lower dynamic constraint, due to such properties and in combination with progressive rupture of alveoli's or cells of said structure 3 which acts like a force limitation barrier protecting the target. Such limitation result of the absorption of incident energy by self-destruction of said projectile 1 by his own energy, and this destruction occurs preferentially to the destruction of material or cells constitutive of the target. Such result is obviously obtained while choosing the foam density if the structure 3 is made of foam and hardness of the hull 2 versus projectile incident energy and target nature. It is therefore possible to realize projectiles that will procure less damages or wound injuries for the same incident energy and projectile caliber. The appreciation is not only a matter of energy/surface unit, but also of energy transmitted to the target by unit of time. Optimization of the concept leads to transfer more energy to the target as a movement quantity transfer but in producing less wound injuries.

A projectile 1 designed according to the present invention is characterized by the increase of shock duration due to the progressive destruction by shearing of wall constitutive of cells or honeycombs of the internal structure 3 providing simultaneously energy absorption of impact, time duration extension of impact and expansion allowing to disperse the transmission the said energy over o wider area. Such projectile could be used as a kinetic payload for non lethal, less than lethal or with controlled effects ammunitions. The individual use of such projectile with a single shot launcher or with multiple effects launchers implies projectile diameter between as used by forces; such calibers between 37 and 57 mm are currently used by law enforcement services or peace keeping military units. For adapted effectors for zone defense or vehicle auto protection, ammunition caliber is usually more important, typically between 80 and 120 mm for existing models; adapted projectiles upon the invention for non lethal purpose could be as small as dimensions near 10 mm, inventors preferred minimal calibers is about 18 mm.

At target impact, cells constituted structure 3 material wall are stressed in compression and collapse; due to the low characteristics in elongation to rupture, typically less than 10%, and in preferred realizations of inventors less than 5%, or less than 3% for some constitutive materials like poly phenols or poly metacrylimids, such constraints induce a shearing rupture of said cells walls, the necessary force is applied symmetrically by reaction onto the target, this force is for such material relatively independent of the speed or dynamic of the application process, that is to said independent of the speed of the projectile impact onto the target. On the contrary, resilient foams like foam based on a polyurethane material (like in patent publication 2005/0066849), shows characteristics allowing to cells a work in collapse even if they break after, due to such characteristics, the force applied to the target will be more dependent of the speed of the projectile at impact. The applied force is dependant in the present invention of the wall resistance to shearing stress, more or less a statistical value by surface or volume unity of the said walls of constitutive cells of structure 3; this force is therefore proportional in this simple case to the foam apparent density. Simultaneously or successively stressed cells walls rupture induce onto the target a deceleration of the projectile and a greater time elongation impact and expansion of the impact area.

Such projectile are constituted by:

At least one rigid internal structure 3, of low apparent density, constituted by cells or alveoli's, possibly of honeycomb type, foam with open or closed cells with composed off materiel or elements characterized with a low elongation capacity, typically less than 10%, with a preferred characteristics of less than 5% length in rupture to elongation and able to support a static compression upon values defined by users to cope with transport and manipulations constraints.

Cell walls fragmentation of said alveoli's of said structure 3 happen under shearing rupture due to a frontal shock under constraints applied against the target, that is to say, typically corresponding in the case of anti-personal use, due to a shock at speeds between 20 and 150 meters/second.

Possible materials to realize such structure could be foam made with poly phenolic, polymetacrylimid, or polycarbonates resin, as well as others polymers used alone or in copolymer structure with other products characterized by their low density and their capacity to hold a high static compression stress relatively to his density, combined with low values of elongation before rupture. It could be constituted of composite assembly as it is possible to find for honeycomb, by example NOMEX is such a brand using polyphenolic matrix which as got a high hold of compression stress and is currently used in structural parts of planes. Such a structure, work like a skeleton in the preservation of the external shape or characteristics of the projectiles during manipulations, ballistic phases of initial acceleration and aerodynamic flight. A hold or resistance to axial compression better than 0.5 MPa is better to ensure the integrity and non-deformation of the forward part during the barrel path and ballistic flight. In addition, there is a need to hold a radial acceleration constraint due to the use in rifled twisted barrel, to avoid that after manipulations some deformation, dislocation or crush occurs inside the launcher. For the benefit of some specific applications, the cavity 7 of the said structure 3 could contain a compound that act at impact as glue.

An external wall 2 hold by and fastened to the said structure 3, principally constituted in mass of elastic or visco-elastic polymer, highly deformable and of elongation capacity better than 100%, even if such stress occurs at the speed of deformation due to the impact on a hard target. Inventors prefer for such a realization where said wall 2 is fastened to said structure 3 by a gluing characterized by a good shearing resistance and a good elongation capacity as well as the material used in the external hull, which doesn't present any rupture after impact.

Said external hull 2 hardness is quite low and remain less than 75 SHORE A. Hardness of the used material is to link with thickness of the said hull, typically less than 2 millimeters thickness for the hardest SHORE grade. The said wall 2 could be thickened if hardness is less than 50 SHORE. The research of the lowest hardness of said hull 2 is always a compromise with friction coefficient of projectile surface, that could be high with material of low hardness, typically between 5 to 20 SHORE, and will rises problems during by example the introduction phase in the launcher. Values between 30 to 50 SHORE are known to be a good compromise between attenuation of impact effect due to elastic or visco-elastics properties and a good hold during manipulations.

The research of the lowest hardness for the outside hull is adapted to the concept of the present invention but is difficult to realize with lower hardness and problems may occur during the introduction or acceleration phase. Using an external hull made with elastic foam, by example with a density higher than 0.5 could be adapted but is difficult and expensive to industrialize with a constant density and doesn't present a substantial advantage in the terminal ballistic effects.

Preferred elastic polymer for the external hull 2 are taken in the following chemical families: polysiloxane, polybutadien, acrylic, silicones or others. Other materials such as polymetacrylats, polyethylene, polyethylene oxides could be used to, especially using chain extensor or plasticizers in percentages greater than 10% (that could lead with some usually hard or resilient polymers in standard manufacturing, to the use of more than 50% of plasticizers in the composition). Compositions based on natural or synthetic rubber could be used to, as well as neoprene, polyethylene oxide or copolymers of every kind of said polymers or together with one of the following list: polyester, polyether, polystyrene, polysiloxane, polyacrylates.

Copolymers of styrene and of others chemicals could achieve the constitution of the said hull 2, important criteria for the product are especially the easiness to manufacture, fastening link with internal structure 3 and the external aspect or friction coefficient. Described manufacturing advices are not limitative of possible manufacturing solutions up to the invention, as it does exist industrially and commercially elastic polymers that could be molded and that have adapted good characteristics, especially: an elongation capacity greater than 100% and a hardness less than 75 SHORE.

Nevertheless, manufacturing will choose product with the said properties but that could be easy to use industrially, with a good properties in un molding and a good finished aspect; in the same way, it must especially be inert and stable over ageing and under encountered environment conditions. Such a realization allow to manufacture a soft product that remain highly deformable at impact, but keep a coherent aerodynamic external shape, first during the launching acceleration or after against aerodynamic forces during the flight.

For average for 37-38 mm or 40 mm calibers, between 50 to 200 Joules are used for law enforcement, walls of cells or alveoli's rupture of the said internal structure 3 constituted of them breaks individually and successively under shearing stress and absorb this energy.

In quasi static compression, corresponding to constraints or forces applied onto the projectile during the manipulation or his mechanical cycle before shooting (introduction, extraction without firing, eventual accidental fall from a human size), the elongation of the external hull 2 combined with a good hold of compression stress, that is to say at least 0.5 MPa with a very low permanent deformation allow to keep the same level of performances, especially aerodynamics ones as well as visual aspect: these kind of solicitations are too weak and the whole projectile 1 is able to stay under deformation levels threshold that will be dangerous for firearms working.

In a way to optimize the realization of a projectile according to the present invention, the rupture of the internal structure 3 by fragile rupture could be effective when a load steers occurs that is equivalent to a shock with the nominal speed of said projectile onto a biological target simulant, typically a gelatin foodstuff block with a water proportion between 70 and 80% or a plastiline ballistic block at 20° C. Such characteristic is necessary to avoid a projectile penetration into so-called soft parts and to limit impact consequences on sensitive parties. With a modern measure equipment, it will appear instantaneously that the duration of temporary cavity formation (or acceleration values of the milieu points) are reduced with the present invention, producing a greater spreading in time and in surface of the impact phenomenon, all external condition equals.

Structure 3 is constituted with a cellular material which embodiment the said described properties, by example a foam with open or closed cells. Such close cells foam made with chemical of the following list: poly methacrylat, polymethacrylimid are preferred by inventors, realization with others open cells foam and with others termo hardening resins are possible, especially with polyphenolics or polycarbonates resins in a way to obtain characteristics adapted in function of the impact speed and of aimed effects on the target. Others realization are possible with more expansive materials or composites, especially using an high tenacity layer and honeycombs by example with a resin like it is made in NOMEX™ (Dupont de Nemours); such realization have a good resistance in static compression or stress, but are going to rapid rupture or collapse when stressed by a shock. The aim is to obtain at impact of the said projectile arriving on a biological simulating target, typically a gelatin foodstuff block with water percentage between 70 and 90%, at the usual speed, a gradual fragmentation and progressive crush of said structure 3. Alveoli's or cells characteristics must be adapted, up to inventors, in both thickness and mean dimensions according to their use and especially of speed of impact onto the target and structure 3 diameter. Such characteristic is compatible with static hold of stress compression, but is a property of fragile rupture appearing when the stress rise with a high rate slope; such characteristic, that could be negative in applications of structural conception, is here considered as an advantage. A hard and resistant structure is in fact in the present invention utilized to crush under a too rapidly growing or to high constraint.

To cope with such aims, it is important to select constitutive materials, and especially the resin, which is preferred by the inventors made with thermo hardened resin and polymerization additives or stabilizers to obtain a strict and controlled parameters condition of said polymerization to obtain a reproducible result in term of density, especially determined by cell wall thickness and mean dimensions. The searched result is specifically and up to chosen realization modes, to obtain low levels of resilience and limited elastic deformation capacity, that is to say low elastic limit typically less than 5% of elongation to rupture allows at the same time to hold small stresses with very small deformations in case of static constraint or manipulation shock, like a drop from a small height, nevertheless can lead to an immediate collapses of all structure or microstructures when the slope of the stress load is to high an overcome a defined threshold at the impact on the target.

To optimize the capacity of said structure to absorb energy, it is important to link this structure 3 to the hull 2, in a way to delay or if possible to suppress the free edge creation onto the structure during the impact. To reach such objective, it is necessary to define an elastic resisting link, that could be especially obtained by gluing, or in the case of one advantageous realization of the projectile with a specific payload, with other product in said payload that act at impact.

Up to a better realization of the present invention, said structure 3 is constituted with material that could be fragmented or dislocated by fragile rupture when a rapid stress or load with a high slope rate occurs. Choice of realization of said structure 3 and of used materials rely on state of the art knowledge relatively to usual or probable impact speed of said projectile, especially for the choice between open cells and closed cells, or others realization forms that combines honeycomb with a foam that could be injected inside honeycomb cells, the final structure could support a quasi static compression strain, but will break in small parts at impact.

Energy throughput to the target, that is to say energy remaining after rupture or destruction of cells walls is linked with size of remaining structure parts after impact. The technical aim is not only to break the structure to free a contend like in U.S. publication 2005/0066849, which correspond to in fact to a quite limited destruction of structure cells, in the best case 10 to 20% of them. The purpose of the present invention is at the contrary to obtain the rupture of about all constitutive wall cells or alveoli's of said structure 3, this result is obtained due to keep the projectile 1 airtight, watertight or dustproof, and especially the hull 2; not allowing any constituent of inside projectile or embedded payload as well as contained gas to go out of it. By example a polyphenolic foam charged at 100 Kilograms/cubic meter of resin contains 90% of gas that must remain inside the said hull 2*r* during impact, associating the cells rupture energy with airbag compression energy to amortize impact of rear parts of the projectile. This airtight property could be obtained with a rigid link, like over molding, gluing or welding. Up to another realization mode of the invention, said internal structure 3 should embodies by example inside his rear part, a cavity or hole 7 that could contain a material block 4 of different nature than the structure material with the purpose to produce complementary effects, especially acting at impact with different modes like elastic deformation like spring compression effect or also buckling, or also creeping, each kind of phenomenon of said block participate to both duration extension and to a greater amortizing. Said block 4 could be elastic and reversibly deformable in projectile axis for small speeds of deformations and can be inserted between the structure 3 and sabot 6 that transfer the gas thrusts; if there is such sabot, in a way to limit to negligible ballistic values variations the consequences of manipulation deformation on said structure 3.

Such block 4, will have a different comportment at impact, and will allow to modulate the global affect of impact projectile 1, especially in function of the speed or in function of the aimed target.

It could be, but without limitation of realization with others types of block, and up to the aimed result:

- of a cell or alveoles foam or honeycomb more fragile or weak than the one used in the structure 3 and of less density, by example aero gel (trademark), or by another example a foam with a density lower than 0.02 like some open cells foams, such realization have similar comportment at impact than a hole or empty cavity,
- on the contrary, said block 4 could house a foam with elastic deformation properties, by example in which air bubbles are going to be deformed at impact with or without rupture; such foam couldn't be used alone due to is very low hold upon stresses, that will not be compatible with safe manipulation, or loading of projectile 1 in good conditions,
- it could also be a gel, a paste or a grease which due to his specific density will modify the respective positions of center of gravity forces application and center of aerodynamic thrust application, as well as projectile mass;
- the said block 4 could also be made of elastic polymer with low reticulation grade, typically less than 500 Dalton.

Other designs to realize projectiles relying on the present invention is with an embedded cavity 7 with honeycomb structure 3 is filled in with foam. Said foam allows in some configurations to amortize the stress applied to the said structure 3 during the launching phase or during manipulation phases or drop during them, but without modification of final performances on the target. This kind of amortizing device could minimize deformation or dynamic constrain induced by launching acceleration on said structure 3. Another action of such amortizor is also to act in increasing the impact duration and therefore also widen the surface of impact.

In another embodiment of projectile 1 to obtain optimized ballistics, at least one cavity 8 is made on the internal face of envelope 2 which is housing a block 5, said block constituted with high density particles or grains, preferred density of used material for these particles is greater than 5, particles could be linked together by a binding agent, by example with a polymer resin with a very low elongation resistance, the overall block made like this will get an apparent density greater than 2. Said block 5 induces, at the impact onto the target, the destruction and witnessing of the structure 3 or of what it is made of. The said cavity 8 especially when positioned forward or projectile 1 could be fill in with metallic particles or metal based chemical of high density, particles needs to be of a sufficient size not to be in a powder volatile configuration, and preferably with a size smaller than 1 mm.

The block 5 position allow to stabilize the projectile 1 on his trajectory with a center of gravity pushed forward.

In another embodiment of the invention, amortizing property and wide area impact of the described projectile allow to embed a payload that could be inserted inside the structure 3, by example:

- an electronic device, by example dedicated to car tracking, at least a pyrotechnic compound with specific function that could modify his efficiency or ballistic terminal performances.
- a delay device that will allow a pyrotechnic initiation or combustion of incapacitating agents and induce a significant enhancement of amortizing.
- A pyrotechnic dispersion device, possibly activated through a pyrotechnic delay relay and that could be equipped with a protection mask defining a preferential cutting of the structure 3 by hot gazes from said dispersion charge, or by all other linked element that is accelerated by said charge combustion as well as an impact triggering device which could be housed inside the first cavity 7. The structure 3 could be used as a barrier to avoid splitters, by example coming from dispersion charge housing to hurt surrounding peoples. The structure could be used in another way to generate low density splitters, without any kinetic neutralizing power, but impressive due to their dimensions and number.
- a pyrotechnic charge making a deafening sound most of the time associated with a blinding light.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A nonlethal kinetic projectile with smaller growth in the intensity of the force applied onto a target at impact due to simultaneous deformation and crushing of the projectile without hurtful parts at impact comprising: an internal structure made with a low density cellular material characterized by a rupture elongation less than 10% and will react at impact by the successive rupture of cells in the cellular material, leading to a shock with a greater duration; an external hull or wall, being airtight and watertight, surrounding said internal structure, said hull being made of a material with a low hardness and an elongation before rupture greater than 100%.

2. The projectile of claim 1, wherein said internal structure is made with a material whose elongation before rupture is less than 5% and will react at impact by the successive rupture of cells in the cellular material, leading to a shock with a greater duration.

3. The projectile of claim 1, wherein said internal structure is made with a material whose density is less than 0.15 and is chosen from the group of the honeycomb shaped, open cell foam and closed cell foam to obtain at impact progressive deceleration that enables a surface spreading of the energy and movement quantities transfer onto the target.

4. The projectile of claim 1 wherein said internal structure has low static deformability which allows the whole projectile to be manipulated and keep its aerodynamic shape during ballistic acceleration and flight and resists an axial constraint greater than 0.5 MPa.

5. The projectile of claim 1, wherein the material used to make said hull is characterized by a hardness lower than 75 SHORE A and a density greater than 1.

6. The projectile of claim 1 further comprising a holder or sabot disposed in the rear part and fastened to said hull to make said internal structure airtight and watertight before, during and after impact and to ensure air tightness and dust-proof characteristics of the hull to residual powder material after impact.

7. The projectile of claim 1, further comprising a cavity located in a forward portion of the projectile, along the axis of said projectile and housed within the internal face of said hull, and designed to amortize stress applied to the internal structure.

8. The projectile of claim 7, wherein the cavity contains dense particles linked to each other by a binding material to form a monolithic part having an apparent density greater than 2.

9. The projectile of claim 1, further comprising a rear cavity along the axis of the projectile within the internal structure and containing payload inside.

10. The projectile of claim 9, wherein said payload comprises a pyrotechnic composition.

11. The projectile of claim 1, wherein the hull is made of material of low resilience having between 10% and 50% plasticizer.

12. The projectile of claim 1, wherein said hull is fastened to the internal structure.

13. The projectile of claim 12, wherein said hull is glued to the internal structure to retain an adapted aerodynamic shape during ballistic acceleration and flight.

* * * * *